US005803067A

United States Patent [19]

Ellenburg et al.

[11] Patent Number: 5,803,067

[45] Date of Patent: Sep. 8, 1998

[54] PIVOTAL SLING STRAP CONNECTORS AND SIGHTS FOR SLINGSHOTS

[75] Inventors: Howard Steve Ellenburg, Boulder, Colo.; Mark Owen Ellenburg, New York, N.Y.

[73] Assignee: Trumark Mfg. Co., Inc., Boulder, Colo.

[21] Appl. No.: 666,000

[22] Filed: Jul. 12, 1996

[51] Int. Cl.[6] ..... F41B 3/02

[52] U.S. Cl. ..... 124/20.1

[58] Field of Search ..... 124/20.1, 20.2, 124/20.3

[56] References Cited

U.S. PATENT DOCUMENTS

| | | | |
|---|---|---|---|
| D. 178,837 | 9/1956 | Huszar . | |
| 257,379 | 5/1882 | Pohlman et al. | 124/20.1 |
| 316,525 | 4/1885 | Cooper | 124/20.1 X |
| 1,153,415 | 9/1915 | Beaty . | |
| 2,667,863 | 2/1954 | Styles . | |
| 2,823,483 | 2/1958 | Malott . | |
| 2,995,129 | 8/1961 | Malott . | |
| 3,974,820 | 8/1976 | Ott . | |
| 3,983,860 | 10/1976 | Bolton . | |
| 4,050,438 | 9/1977 | Pfotenhauer . | |
| 4,169,453 | 10/1979 | Hunsicker | 124/20.1 |
| 4,250,861 | 2/1981 | Ellenburg . | |
| 4,411,248 | 10/1983 | Kivenson | 124/20.1 |
| 4,651,707 | 3/1987 | Bozek | 124/17 |
| 4,703,744 | 11/1987 | Taylor et al. . | |
| 4,873,964 | 10/1989 | Bonoan | 124/20.1 |
| 5,016,601 | 5/1991 | Ferguson et al. | 124/20.1 |
| 5,072,715 | 12/1991 | Barr | 124/20.1 |
| 5,243,955 | 9/1993 | Farless | 124/20.1 |
| 5,345,922 | 9/1994 | Ott | 124/20.1 |

FOREIGN PATENT DOCUMENTS

| | | |
|---|---|---|
| 626879 | 7/1949 | United Kingdom . |
| 754254 | 8/1956 | United Kingdom . |
| 2031743 | 4/1980 | United Kingdom . |
| 2035106 | 6/1980 | United Kingdom . |
| 2136698 | 9/1984 | United Kingdom . |

*Primary Examiner*—John A. Ricci
*Attorney, Agent, or Firm*—Townsend and Townsend and Crew

[57] ABSTRACT

A sling shot includes a basic Y-shaped frame including a handle, two upstanding yoke branches, and two elastic sling straps extending between a respective yoke branch and a pouch for receiving a projectile to be propelled. The upper end of each yoke branch is provided with a connector member rotatably connected thereto, the rotation of each connector member preferably limited to about 180 degrees. Each connector member includes an elongated prong to receive an elastic strap. When the elastic straps are stretched rearward, the connector members will rotate so that the elongated prongs are in line with their respective elastic straps. When the elastic straps are released to propel a projectile, the forward movement will cause the connector members to pivot so that the elongated prongs will remain in line with the ends of their respective elastic straps, thus preventing the elastic straps from going into twists or kinks. Each connector member may also include a strut with a sight bead which is visible in the sight window when the straps are pulled rearward, to assist in aiming.

18 Claims, 5 Drawing Sheets

Fig. 5
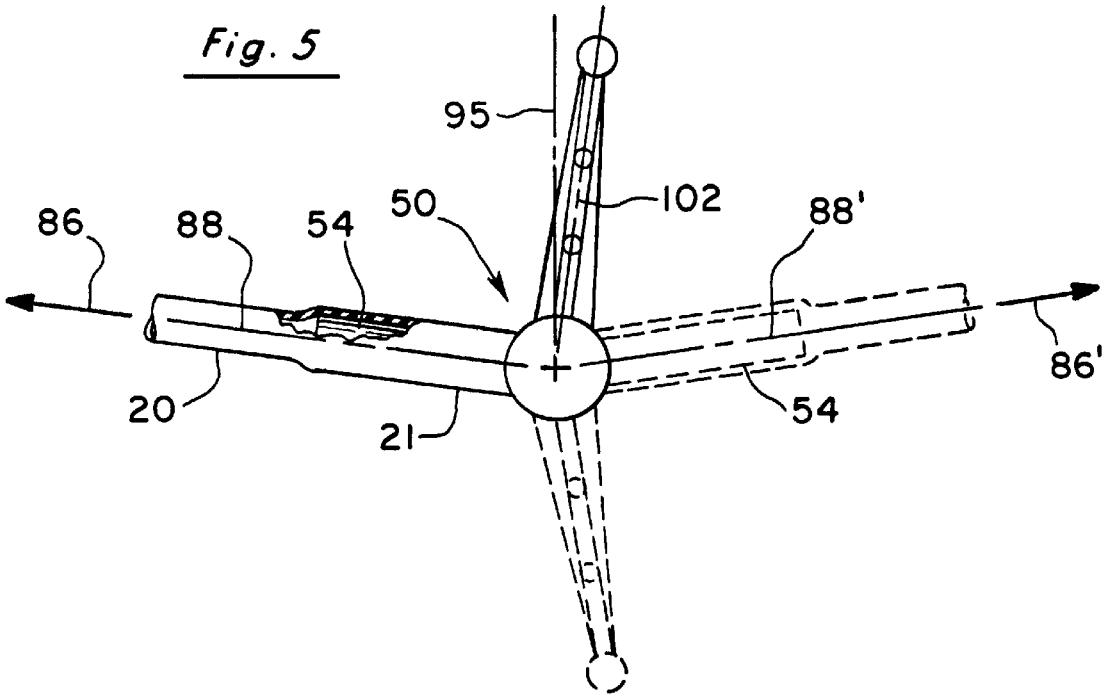
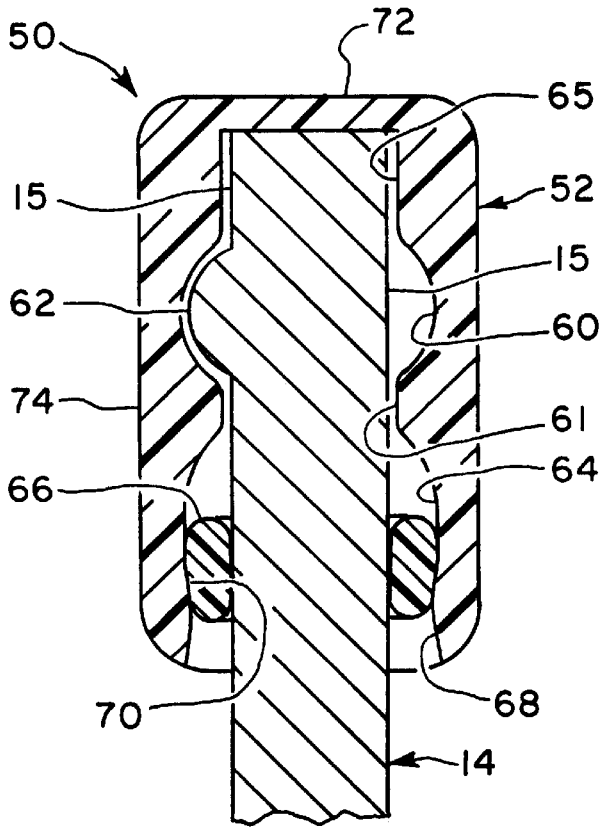
Fig. 6

PIVOTAL SLING STRAP CONNECTORS AND SIGHTS FOR SLINGSHOTS

BACKGROUND OF THE INVENTION

1. Field of the Invention

This invention relates to slingshots and more specifically to pivotal sling strap connectors and sights for slingshots.

2. Brief Description of the Prior Art

Slingshots are essentially very simple toys or weapons that utilize elastic sling straps connected between distal ends of a Y-shaped frame or yoke and a sling or pouch to fling a small stone or other projectile. While this basic structure has not changed, there have been improvements to various parts of the basic structure. For example, the basic Y-frame of metal rods extending from a form-shaped handle are lightweight yet strong and comfortable to grip. the elastic sling straps are more effective and easier to attach when made of rubberized tube, and foldable wrist braces provide additional stability, all of which features are shown and described in detail in U.S. Pat. No. 4.250,861, issued to H. Ellenburg, one of the joint inventors of this invention and which patent is incorporated herein by reference. However, such improved slingshot structures still have several drawbacks. For example, sling shapes, especially rubber tubes, tend to weaken and eventually break where they attach to the rigid distal ends of the Y-shaped frame or yoke due to the intense strain at the point of connection as the strap is stretched taut in one direction and then whips forcefully in the opposite direction when released to launch the projectile. Also, little has been done to provide effective aiming aids or sights for slingshots.

SUMMARY OF THE INVENTION

Accordingly, it is an object of the present invention to provide an improved connection for elastic straps to yokes of slingshots to reduce wear and weakening of the straps at the connections.

It is also an object of this invention to provide improved aiming aids or sights for slingshots.

To achieve the foregoing aid other objects and in accordance with the purposes of the present invention as embodied and described herein,. the improved slingshot apparatus of this invention may comprise pivotal connectors on the distal ends of the respective yoke branches to connect the sling straps to the yoke branches with enough rotational range to accommodate application of tensile forces co-axial with the connection axes at the opposite extremities of sting strap motion. Such range is preferably, but not necessarily, less than 360 degrees. The rotational range is set by limit stops in the connectors. Elongated sights extend from the pivotal connectors toward the center of the slingshot and pivot with the connectors out of the path of the projectile being launched by the slingshot as the projectile passes through the slingshot.

Additional objects, advantages, and novel features of the invention shall be set forth in part in the description that follows, and in part will become apparent to those skilled in the art upon examination of the following or may be learned by the practice of the invention. The objects and the advantages may be realized and attained by means of the instrumentalities and in combinations particularly pointed out in the appended claims.

BRIEF DESCRIPTION OF THE DRAWINGS

The accompanying drawings, which are incorporated in and form a part of the specifications, illustrate the preferred embodiments of the present invention, and together with the descriptions serve to explain the principles of the invention. In the Drawings:

FIG. 5 is an enlarged top plan view of one of the pivotal connectors and a short segment of the sling strap connected thereto illustrating the tensile forces at opposite fully extended positions of the sling strap; and FIG. 6 is a cross-sectional view of a pivotal connector of this invention taken along section line 6—6 of FIG. 2.

DETAILED DESCRIPTION OF THE PREFERRED EMBODIMENTS

Figure 1:
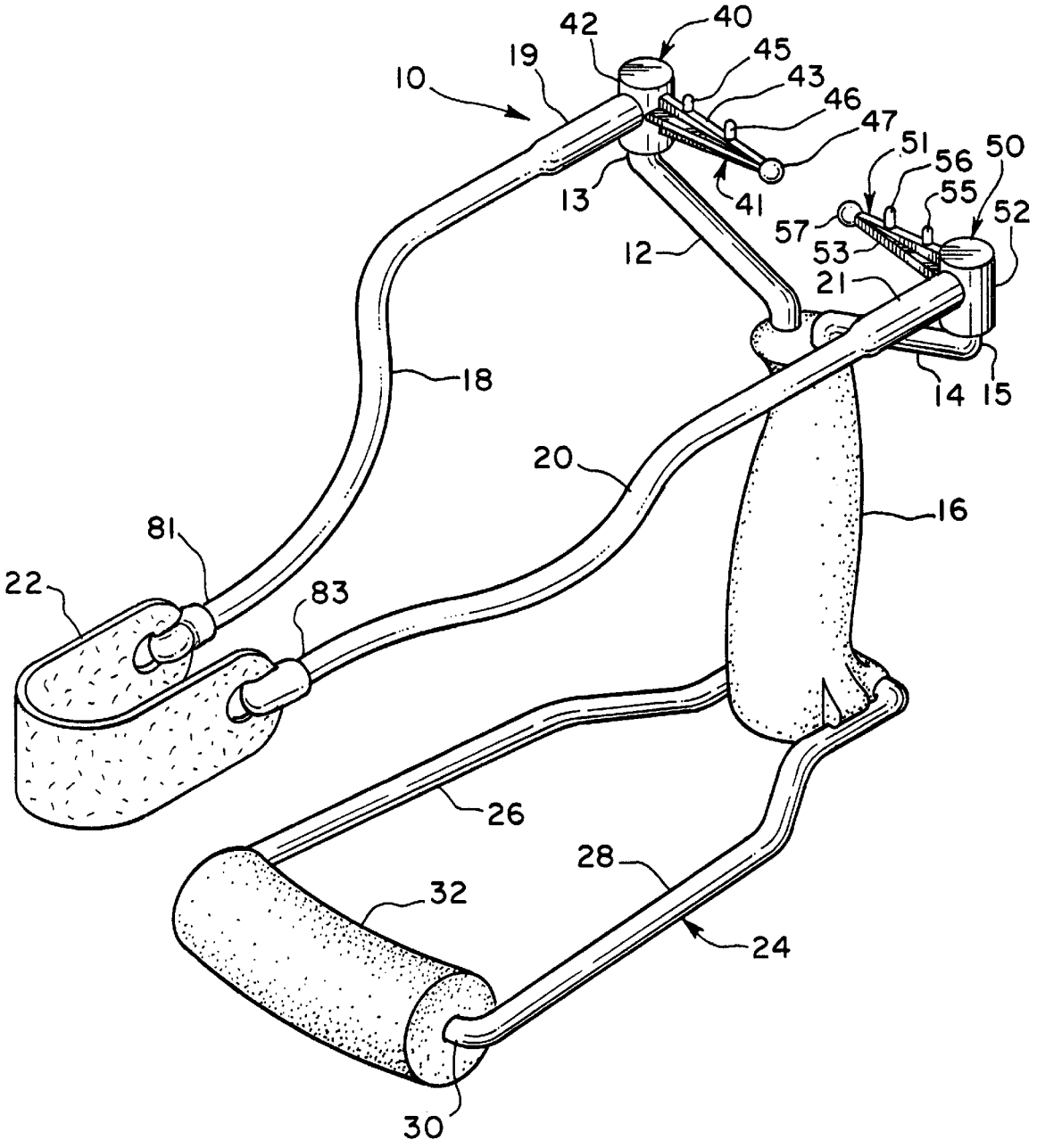
FIG. 1 is an isometric view of the improved slingshot according to this invention.

The improved slingshot 10 according to the present invention can have any suitable variation of the basic Y-shaped frame, elastic or rubber sling straps, and pouch, as the invention features reside primarily in the pivotal connectors 42, 52 for the proximal ends 19, 21 of the respective sling straps 18, 20, and the sights 41, 51 extending radially from the respective connectors 40, 50. For purposes of illustration, the basic slingshot structure shown in FIGS. 1–4 is similar to that shown and described in U.S. Pat. No. 4,250,861, which is incorporated by reference herein, except for the connectors 40, 50 and sights 41, 51, as will be described in more detail below. The Y-shaped frame comprises generally two branches 12, 14 of a yoke extending upwardly and outwardly from a handle or hand grip 16, two elastic or rubber sling straps 18, 20 connected at their proximal ends 19, 21 to the distal ends 13, 15 of yoke branches 12, 14 and connected at their distal ends 81, 83 to a pouch 22, and a wrist brace 24 comprising rearwardly-extending rigid members 26, 28, and a transverse end member 30 covered by a cylindrical cushion 32. Additional details of the basic slingshot structure are shown and described in U.S. Pat. No. 4,250,861.

Figure 2:
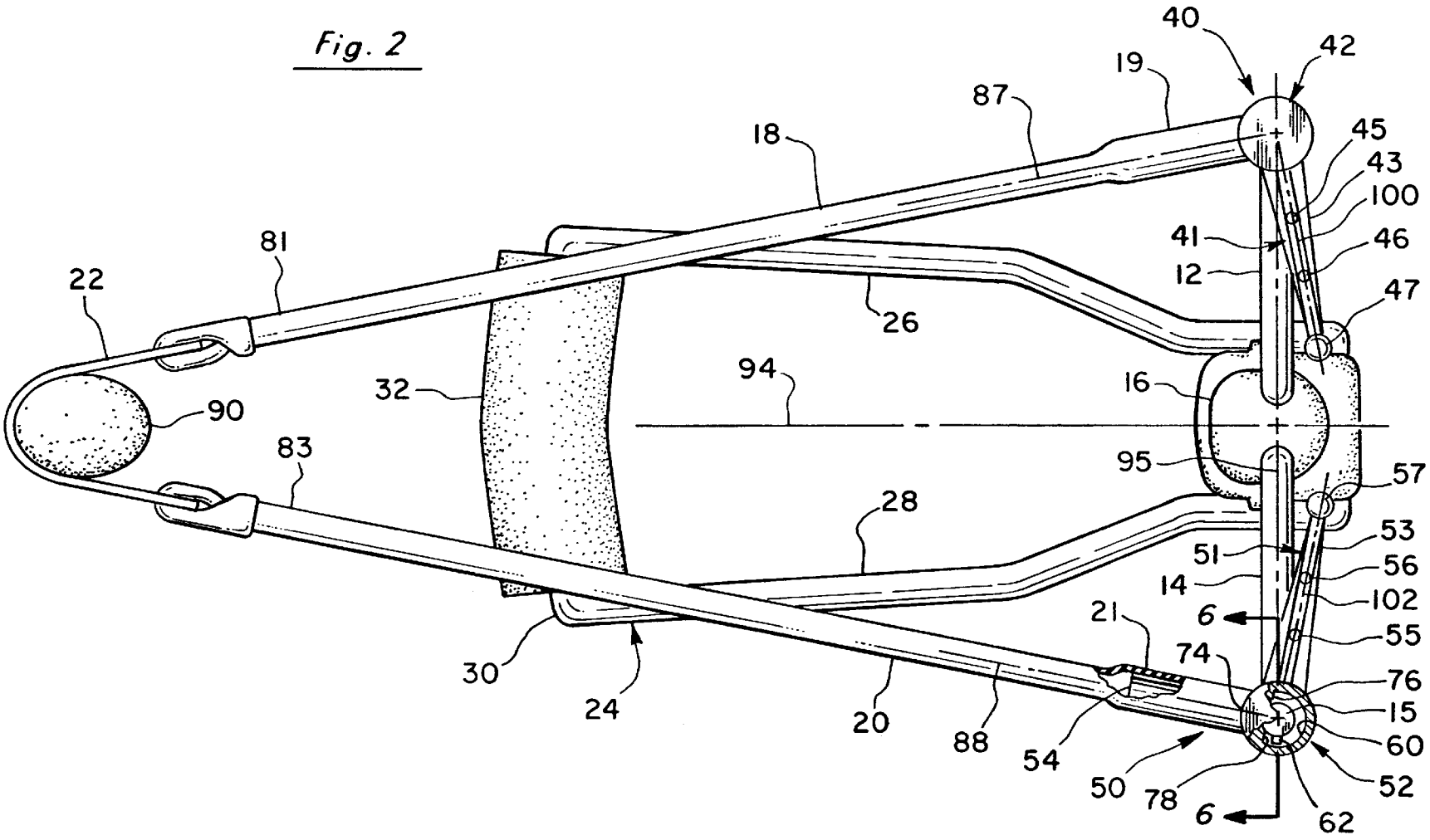
FIG. 2 is a top plan view of the improved slingshot according to this invention with a projectile positioned in the pouch and the elastic sling straps stretched taut in condition to launch the projectile and with a portion of one sting strap end cut away to reveal its attachment to the pivotal connector of this invention and a portion of the pivotal connector cut away to reveal the pivotal mounting structure and limit stop mechanism that limits pivoting of the connector according to this invention.

Referring now primarily to FIGS. 1, 2, and 6, the connectors 40, 50 are substantially the same, but are pivotally mounted on opposite distal ends 13, 15 of the yoke branches 12, 14. Therefore, only one of the connectors, connector 50 pivotally mounted on the distal end 15 of yoke branch 14, is described in detail with the understanding that the other connector 40 mounted on distal end 13 of yoke branch 12 is substantially the same structure. Also, while this invention is described with tubular straps 18, 20, flat straps or other shapes and appropriate fastening apparatus for attaching the straps to connectors 40, 50 can also be used within the scope of this invention.

Connector 50 comprises a substantially cylindrical rotor 52 with a hole 65 extending axial therein from an opening 68. The hole 65 has an annular internal groove 60 that extends preferably, but not necessarily, only partially around the periphery of the hole 65, terminating at shoulders 76, 78, as best seen in FIG. 2. The rotor 52 is positioned with the distal end 15 of yoke branch 14 inserted into hole 65 to the bearing end wall 72. A protrusion 62 extends radially outward from the yoke branch 14 into the groove 60. A shoulder 61 between groove 60 and a wider portion 64 adjacent opening 68 co-acts with protrusion 62 to retain the rotor 52 axially on the distal end 15 of yoke branch 14 while allowing the rotor to rotate about the yoke branch 14 to the angular extent of groove 60 between shoulders 76, 78. In other words, the rotor 52 can pivot or rotate in one angular direction about distal end 15 of yoke branch 14 until protrusion 62 abuts shoulder 76 and in the opposite angular direction until protrusion 62 abuts the other shoulder 78. The rotor 50 is preferably fabricated of a tough, but slightly resilient nylon or plastic material that yields just enough to allow the protrusion to squeeze past the shoulder 61 during assembly. An annular bearing ring 66 is inserted into the wider portion 64 of hole 65 to provide an additional stabilizing rotatable bearing surface around the yoke branch 14. A slight detent 70 in the interior surface of wall 74 of rotor 52 helps to retain the bearing ring 66 in position.

Referring now primarily to FIG. 2, an elongated prong 54 extends radially outward from the wall 74 of rotor 52. This prong 54 is sized with a diameter such that the tubular sling strap 20 has to be stretched in order for the prong 54 to be inserted into the distal end 21 of the sling strap 20. With sufficient length of prong 54 inserted into sling strap 20, friction can retain the sling strap 20 on the prong 54 or an appropriate adhesive (not shown) can be used. The sling strap 18 is attached to connector 40 in the same manner. However, as mentioned above, sling straps of other configurations (not shown) other than tubular can be connected to connectors 40, 50 in any appropriate manner without departing from the concepts and scope of this invention.

In operation, as the sling straps are stretched taut, as illustrated in FIGS. 2 and 5 to launch a projectile 90 in pouch 22, the tensile force applied by the sling strap 20 to connector 50 pivots the rotor 52 until the prong 54 aligns axially with the sling strap 20. Therefore, the force indicated in FIG. 5 by arrow 86 at the connection of sling strap 20 to connector 50 is substantially only co-axial with the sling strap 20, as indicated in FIG. 5 by the longitudinal axis 88, with essentially no twists or kinks at the connection.

Figure 3:
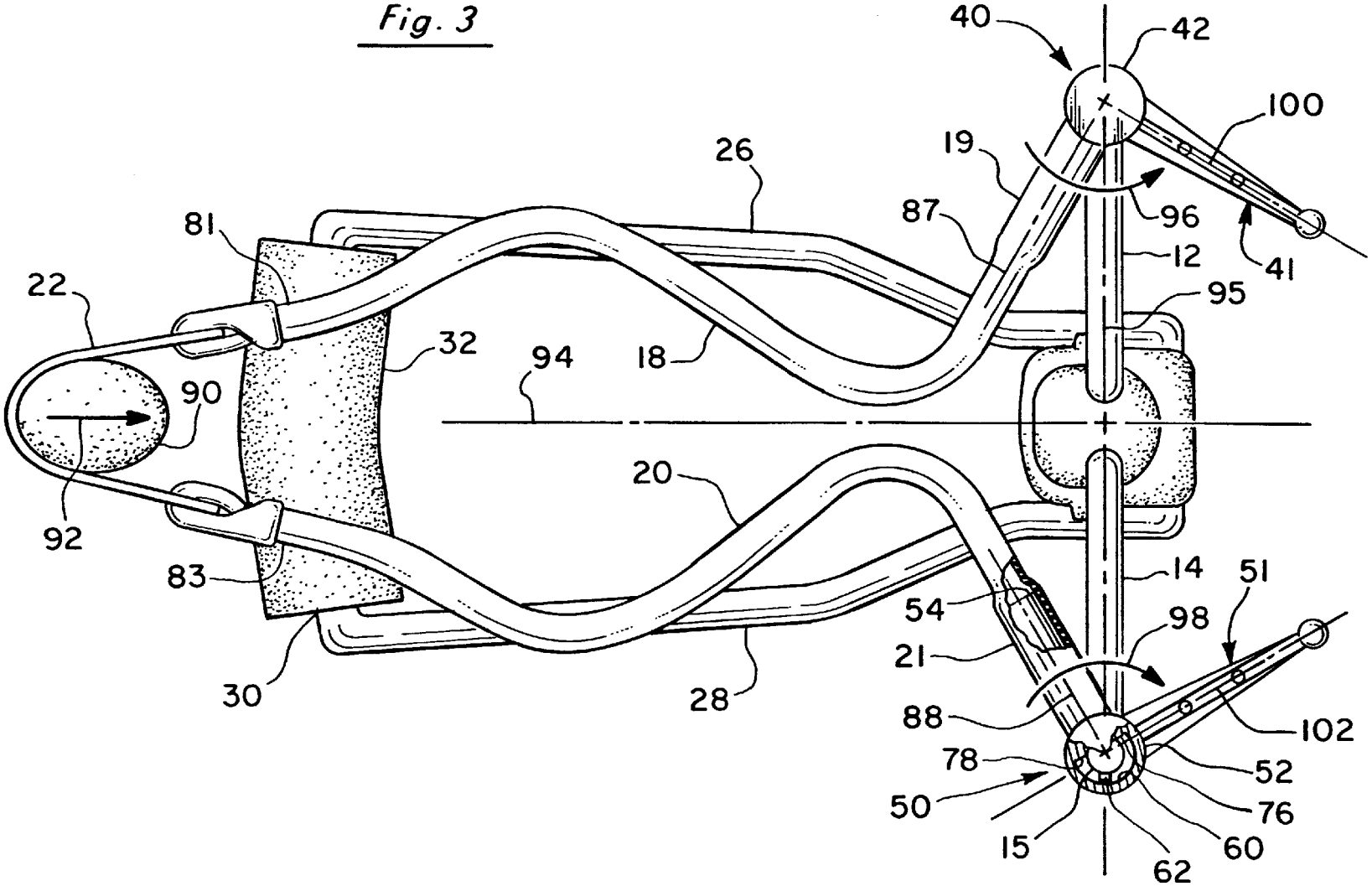
FIG. 3 is a top plan view similar to FIG. 2, but showing the pivotal connectors and sights beginning to pivot or rotate after this sling straps are released to launch the projectile.
Figure 4:
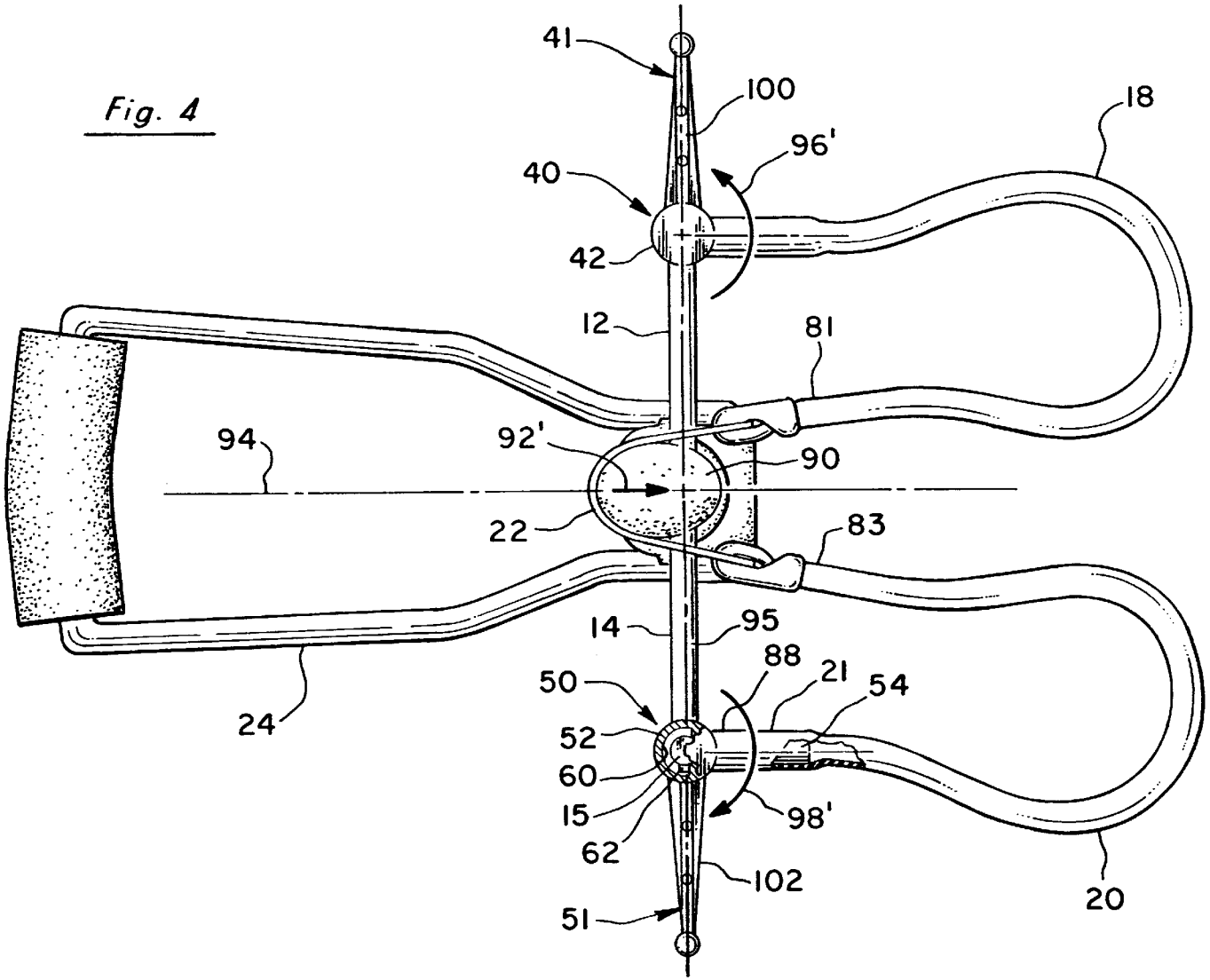
FIG. 4 is a top plan view similar to FIGS. 2 and 2, but showing the pivotal connectors and sights fully rotated as the sling straps are fully relaxed and the pouch and projectile proceed through the yoke during launch.

Then, when the pouch 22 and sling straps 18, 20 are released to launch the projectile 90, as illustrated in FIG. 3, the sling straps 18, 20 release the potential energy in the sling straps 18, 20 and, as a result, propel the sling straps 18, 20 and projectile 90 forwardly, as indicated by arrow 92, substantially parallel to the longitudinal axis 94 of slingshot 10. As the sling straps 18, 20 are propelled forwardly, they cause the respective connectors 40, 50 to pivot as indicated by respective arrows 96, 98 in FIG. 3. As the sling straps 18, 20 and projectile 90 continue their forward movement, as indicated by arrow 92' in FIG. 4, the sling straps 18, 20 continue to pivot the connectors 40, 50, as indicated by respective arrows 96', 98', until the prong 54 of connector 50 (and similar prong—not shown—of connector 40) are oriented in substantially the opposite direction or nearly 180 degrees rotation from the starting position of FIG. 2. Therefore, when the sling straps 18, 20 reach the maximum extremity of their forward movement, the tensile force indicated by arrow 86' in FIG. 5 is still substantially axially aligned with the longitudinal axis 88' of the prong 54. Therefore, as illustrated and described above, as the sling straps 18, 20 whip forward from one extremity to the other, the pivotal connectors 40, 50 prevent the sling straps 18, 20 from going into twists or kinks at their connections with the connectors 40, 50. This feature decreases wear and tear on the sling straps 18, 20 and prolongs their useful life. The shoulders 76, 78 at opposite ends of semi-annular groove 60 interact with the protrusion 62, as described above and shown in FIG. 2, to limit rotation of the connector 50 to something less than 360 degrees, preferably approximately 180 degrees, to keep the sling straps 18, 20 from getting twisted. Also, allowing the connector to rotate more than 90 degrees and preferably approximately 180 degrees as shown in FIG. 4, the projectile 90 is prevented from hitting the sling straps 18, 20 where they attach to connectors 40, 50, thus also allowing better shooting accuracy as well as decreasing wear and tear on the sling straps 18, 20.

This invention can also include sights 41, 51, which, when extending radially outward from respective rotors 42, 52 of pivotal connectors 40, 50, advantageously also pivot along with the connectors 40, 50. Therefore, when the sights 41, 51 extend outwardly along respective longitudinal axes 100, 102 that are oriented approximately 90 degrees from the connection longitudinal axes 87, 88, as illustrated in FIG. 2, the distal ends 47, 57 of sights 41, 51 extend transversely toward each other between yoke branches 12, 14 and connectors 40, 50. In this position of FIG. 2 with the sling straps 18, 20 pulled taut and ready to launch the projectile 90, the user can use the sights 41, 51 to help aim the projectile at a target. The sights 41, 51 illustrated in FIGS. 1–4 each comprise an outrigger strut 43, 53 with a spherical bead at its distal end 47, 57. Nubs 45, 46 and 55, 56 protruding upwardly from struts 43, 53 can facilitate aiming. Especially when the slingshot is rotated 90 degrees (not shown) so that the transverse axis 95 of the slingshot 10 is approximately vertical, the nubs 45, 46 and 55, 56 can be used to help estimate an amount to aim vertically over a target to offset gravitational effects on the projectile 90 in trajectory (not shown). Then, as the projectile 90 moves along longitudinal axis 90 between the yoke branches 12, 14 and connectors 40, 50, as illustrated in FIGS. 3 and 4 and described above, the sights 41, 51 pivot out of the path of the projectile 90 to avoid contact of the projectile 90 with the sights 41, 51.

While the angular rotation of the rotors 42, 52 accommodated by the groove 60 in the preferred embodiment is approximately 180 degrees, as described above, there is nothing mandatory about that range of movement. It could easily be more or less than 180 degrees by substantial amounts, such as plus or minus at least 60 degrees or more, and still function for the purposes of this invention. The principle feature is that the angular rotation range be at least enough to accommodate straight axial alignment of the tensile forces 86, 86' exerted by the sling straps 18, 20 with the attachment axes 88, 88' at opposite extremities of movement of the sling straps 18, 20. As illustrated in FIGS. 2–5, because the sling straps 18, 20 converge toward the pouch 22, the actual angular rotation required between such extremities may be slightly less than 180 degrees, although, as illustrated in FIG. 4, there may be some wider rotation to the full 180 degree position shown, i.e., the connection axis 88 being 90 degrees beyond or perpendicular to the transverse axis 95 and approximately parallel to the longitudinal axis 94 of the slingshot 10.

Also, because the sight axis 100, 102 are set about perpendicular to the respective connection axes 87, 88, the initial positions of the sights 41, 51 when the sling straps 18, 20 are stretched taut for launching a projectile 90, as shown in FIG. 2, may not quite parallel to the transverse axis 95. Depending on the lengths of sling straps 18, 20 when stretched taut and the distance between rotors 42, 52, the sight axes 100, 102 may be at angles as much as 5–25 degrees to the transverse axis 95. When the connectors 40, 50 are fully rotated in the direction of arrows 96', 98' as shown in FIG. 4, the sight axes 100, 102 are approximately parallel to the transverse axis 95, but the sights 41, 51 are extending in opposite directions away from each other. Again, these orientations and rotational ranges do not require any special precision. If the sights 41, 51 are near the center of the slingshot 10 as defined by the longitudinal axis before launch for effective aiming of the projectile 90 and pivot out of the path of the projectile 90 as it passes through the slingshot 10, the orientation and rotational range of the sights 41, 51 are satisfactory for purposes of this invention.

The foregoing description is considered as illustrative only of the principles of the invention. Furthermore, since numerous modifications and changes will readily occur to those skilled in the art, it is not desired to limit the invention to the exact construction and process shown as described above. Accordingly, all suitable modifications and equivalents may be resorted to falling within the scope of the invention as defined by the claims which follow.

The embodiments of the invention in which an exclusive property or privilege is claimed are defined as follows:

1. Slingshot apparatus, comprising:

a frame having a first branch with a first distal end and a second branch with a second distal end;

a first sling strap and a second sling strap;

a first rotor with a first hole extending axially into said first rotor, said first rotor being positioned rotatably on said first branch with said first distal end of said first branch inserted into said first hole in said first rotor;

a second rotor with a second hole extending axially into said second rotor, said second rotor being positioned rotatably on said second branch with said second distal end of said second branch inserted into said second hole in said second rotor;

a first prong extending radially outward from said first rotor and said first sling strap having a first tubular proximal end with said first prong being inserted into said first tubular proximal end; and a second prong extending radially outward from said second rotor, and said second sling strap having a second tubular proximal end with said second prong being inserted into said second tubular proximal end.

2. The slingshot apparatus of claim 1, wherein:

said first rotor has a limit stop that limits rotation of said first rotor to less than 360 degrees; and said second rotor has a limit stop that limits rotation of said second rotor to less than 360 degrees.

3. The slingshot apparatus of claim 2, wherein:

said first rotor has a limit stop that limits rotation of said first rotor to approximately 180 degrees, where approximately means ±60 degrees; and said second rotor has a limit stop that limits rotation of said second rotor to approximately 180 degrees, where approximately means ±60 degrees.

4. The slingshot apparatus of claim 3, including:

a first sight extending radially outward from said first rotor; and a second sight extending radially outward from said second rotor.

5. The slingshot apparatus of claim 4, wherein:

said first sight extends radially outward from said first rotor at an orientation spaced angularly from said first prong by approximately 90 degrees where approximately means ±30 degrees; and said second sight extends radially outward from said second rotor at an orientation spaced angularly from said second prong by approximately 90 degrees where approximately means ±30 degrees.

6. The slingshot apparatus of claim 3, wherein:

said first limit stop includes a first semi-annular groove in said first hole in said first rotor with a shoulder at each end of said semi-annular groove, and a first protrusion protruding radially outward from first distal end of said first branch; and said second limit stop includes a second semi-annular groove in said second rotor with a shoulder at each end of said semi-annular groove, and a second protrusion protruding radially outward from second distal end of said second branch.

7. The slingshot apparatus of claim 1, including a first elongated sight extending radially from said first rotor.

8. The slingshot apparatus of claim 7, including a second elongated sight extending radially from said second rotor.

9. Slingshot apparatus, comprising:

a frame having a first branch and a second branch;

a first connector mounted pivotally on said first branch;

a second connector on said second branch;

a first sling strap attached to said first connector and a second sling strap attached to to said second connector; and a first sight extending radially from said first connector.

10. The slingshot apparatus of claim 9, wherein said second connector is mounted pivotally on said second branch.

11. The slingshot apparatus of claim 10, including a second sight extending radially from said second connector.

12. The slingshot apparatus of claim 11, wherein:

said first connector has a limit stop that limits pivotal rotation of said first connector to less than 360 degrees; and said second connector has a limit stop that limits pivotal rotation of said second connector to less than 360 degrees.

13. The slingshot apparatus of claim 12, wherein:

said first connector has a limit stop that limits pivotal rotation of said first connector to approximately 180 degrees, where approximately means ±60 degrees; and said second connector has a limit stop that limits pivotal rotation of said second connector to approximately 180 degrees, where approximately means ±60 degrees.

14. The slingshot apparatus of claim 13, wherein:

said first connector includes a first rotor with a first hole extending axially into said first rotor, said first rotor being positioned rotatably on said first branch with said first distal end of said first branch inserted into said first hole in said first rotor; and a second rotor with a second hole extending axially into said second rotor, said second rotor being positioned rotatably on said second branch with said second distal end of said second branch inserted into said second hole in said second rotor.

15. The slingshot apparatus of claim 14, wherein:

said first limit stop includes a first semi-annular groove in said first hole in said first rotor with a shoulder at each end of said semi-annular groove, and a first protrusion protruding radially outward from first distal end of said first branch; and said second limit stop includes a second semi-annular groove in said second rotor with a shoulder at each end of said semi-annular groove, and a second protrusion protruding radially outward from second distal end of said second branch.

16. The slingshot apparatus of claim 15, wherein:

said first connector includes a first fastener on said first rotor, said first sling strap being connected to said first rotor by said first fastener; and said second connector includes a second fastener on said second rotor, said second sling strap being connected to said second rotor by said second fastener.

17. The slingshot apparatus of claim 16, wherein:

said first fastener includes a first prong extending radially outward from said first rotor and said first sling strap having a first tubular proximal end with said first prong being inserted into said first tubular proximal end; and said second fastener includes a second prong extending radially outward from said second rotor and said second sling strap having a second tubular proximal end with said second prong being inserted into said second tubular proximal end.

18. The slingshot apparatus of claim 17, wherein:

said first sight extends radially outward from said first rotor at an orientation spaced angularly from said first prong by approximately 90 degrees where approximately means ±30 degrees; and said second sight extends radially outward from said second rotor at an orientation spaced angularly from said second prong by approximately 90 degrees where approximately means ±30 degrees.

* * * * *